US012305511B2

(12) United States Patent
Uddin et al.

(10) Patent No.: US 12,305,511 B2
(45) Date of Patent: May 20, 2025

(54) DRILLING SYSTEM WITH MUD MOTOR AND ANNULAR FLOW RESTRICTOR

(71) Applicant: Halliburton Energy Services, Inc., Houston, TX (US)

(72) Inventors: Hasib Uddin, Houston, TX (US); Ricardo Ortiz, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/643,106

(22) Filed: Apr. 23, 2024

(65) Prior Publication Data

US 2024/0376782 A1 Nov. 14, 2024

Related U.S. Application Data

(60) Provisional application No. 63/500,926, filed on May 9, 2023.

(51) Int. Cl.

| | |
|---|---|
| ***E21B 7/04*** | (2006.01) |
| ***E21B 4/00*** | (2006.01) |
| ***E21B 4/02*** | (2006.01) |

(52) U.S. Cl.

CPC ..... *E21B 7/04* (2013.01); *E21B 4/003* (2013.01); *E21B 4/02* (2013.01)

(58) Field of Classification Search

CPC ... E21B 7/04; E21B 7/06; E21B 4/003; E21B 4/02

See application file for complete search history.

(56) References Cited

U.S. PATENT DOCUMENTS

| | | | |
|---|---|---|---|
| 3,456,746 | A | 7/1969 | Garrison |
| 3,936,247 | A | 2/1976 | Tschirky et al. |
| 3,982,797 | A | 9/1976 | Tschirky et al. |
| 3,982,859 | A | 9/1976 | Tschirky et al. |
| 5,351,766 | A | 10/1994 | Wenzel et al. |

(Continued)

FOREIGN PATENT DOCUMENTS

| | | | |
|---|---|---|---|
| KR | 101645588 | B1 | 8/2016 |
| WO | 2019210329 | A1 | 10/2019 |

OTHER PUBLICATIONS

International Search Report and Written Opinion dated Aug. 7, 2024 for related PCT Patent Application No. PCT/US2024/025912 filed Apr. 24, 2024.

*Primary Examiner* — Dany E Akakpo
(74) *Attorney, Agent, or Firm* — K&L Gates LLP

(57) ABSTRACT

A bottom hole assembly ("BHA") includes a driveshaft including a bore through which the drilling fluid is flowable. The BHA also includes a bearing assembly configured to rotatably support the driveshaft that includes a radial bearing with an internal radial gap; an annular flow restrictor with an inner sleeve and an outer sleeve separated by a restrictor clearance; and a bypass fluid flow path open to the bore and extending through the radial gap and the restrictor clearance such that at least some drilling fluid is diverted from the bore into the bypass fluid flow path. The restrictor clearance is sized to restrict flow of the drilling fluid diverted through the bypass fluid flow path to control a pressure of the drilling fluid in the driveshaft. The outer sleeve is dynamically radially supported such that a radial load absorbed by the annular flow restrictor is below a selected threshold.

20 Claims, 6 Drawing Sheets

(56) References Cited

U.S. PATENT DOCUMENTS

| | | | | |
|---|---|---|---|---|
| 6,250,806 | B1 * | 6/2001 | Beshoory | E21B 4/003 384/97 |
| 6,416,225 | B1 | 7/2002 | Cioceanu et al. | |
| 11,655,678 | B2 | 5/2023 | Munguia et al. | |
| 2004/0104051 | A1 | 6/2004 | Moriarty | |
| 2013/0161029 | A1 | 6/2013 | Kaase | |
| 2023/0011364 | A1 * | 1/2023 | Munguia | E21B 7/068 |

* cited by examiner

DRILLING SYSTEM WITH MUD MOTOR AND ANNULAR FLOW RESTRICTOR

BACKGROUND

Directional drilling involves drilling a wellbore that deviates from a vertical path, such as drilling horizontally through a subterranean formation. Rotary steerable systems are employed to control the direction of a drill bit while drilling. In a point-the-bit rotary steerable system, an internal shaft within the system is deflected to direct the drill bit. In a push-the-bit rotary steerable system, a pad pushes against the subterranean formation to direct the bit.

A push-the-bit rotary steerable system includes a motor with a bearing section. The bearing section may be sealed and lubricated by internal oil or unsealed and lubricated by drilling fluid flowing through the mud motor to the drill bit. For an unsealed bearing section, drilling fluid that is bypassed from the main bore to lubricate the bearings may be lost to the annulus due to bearing tolerances, manufacturing constraints, and erosive wear from the flowing mud. However, the bypass flow rate must be controlled such that sufficient drilling fluid stays in the driveshaft and flows to the rotary steerable system to provide pad force to steer the drill bit while avoiding excess erosion.

Bypass flow control increases in importance when the mud motor is used for a Motor-Assisted Rotary Steerable System (MARSS) application. In a MARSS application, typically the radial bearing gaps perform the main restriction at the mud motor bearing section that controls the mud flow leak to the annulus. But, as the run progresses the radial bearings can wear out and cause the flow restriction to drop, which in turn allows excessive leakage. Including a choke to control fluid flowing out of the bearings through the bypass can help solve the radial bearing wear issue. However, such chokes may rely on a metal-to-metal face seal between a rotating and a stationary face and such a design may be subject to abrasion degradation. Material options for accomplishing flow control are also limited for high pressure/volume (PV) loading. Specifically, for a MARSS application, the pressure below the mud motor and above the bearing section can increase, causing additional degradation of a metal-to-metal face seal due to higher pressure in the bypass flow path. A need therefore exists for a means of controlling the bypass flow of drilling fluid to the annulus.

BRIEF DESCRIPTION OF THE DRAWINGS

Aspects of the disclosure are described with reference to the following figures. The same or sequentially similar numbers are used throughout the figures to reference like features and components. The features depicted in the figures are not necessarily shown to scale. Certain features may be shown exaggerated in scale or in somewhat schematic form, and some details of elements may not be shown in the interest of clarity and conciseness.

DETAILED DESCRIPTION

Figure 1:
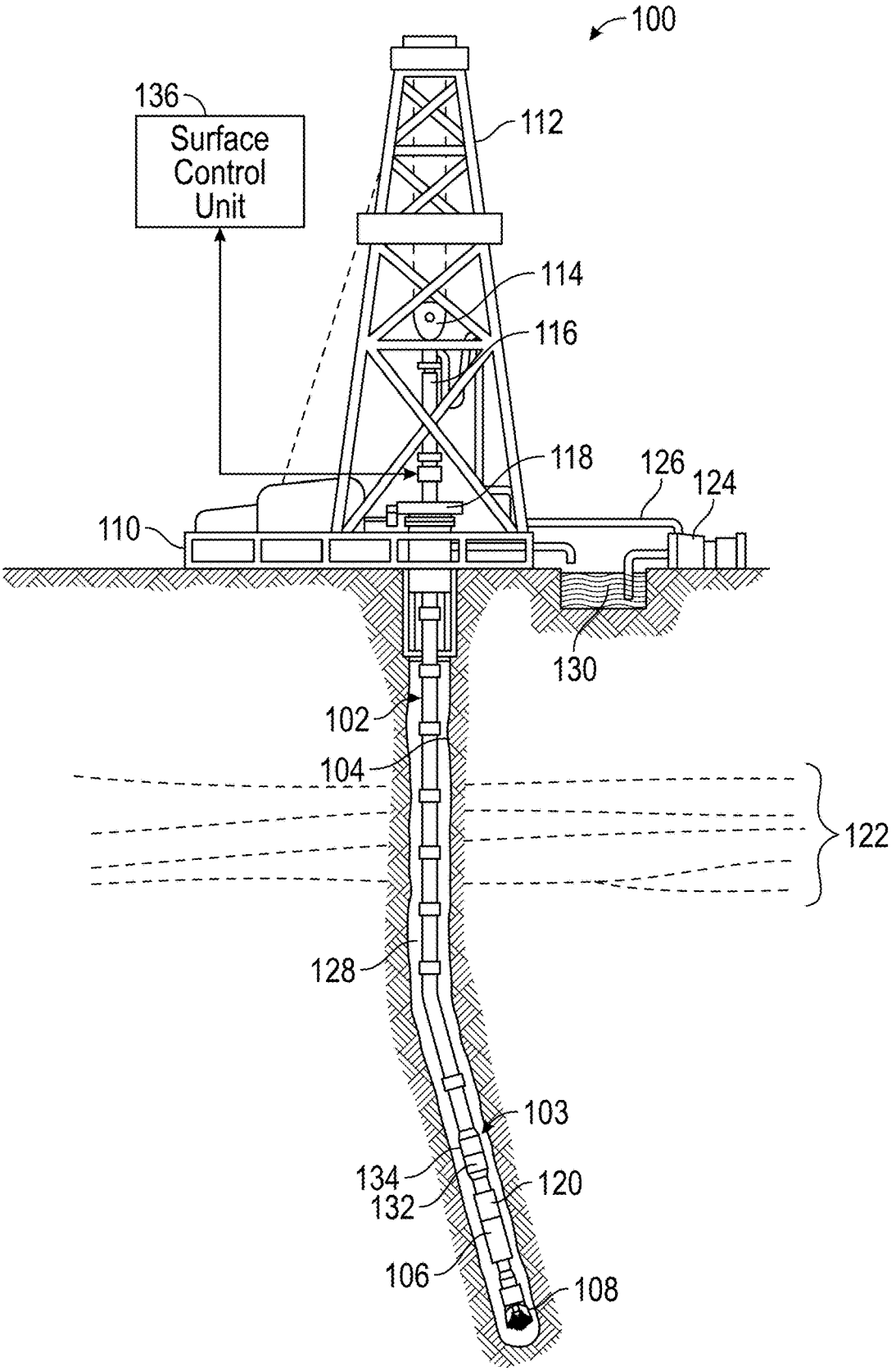
FIG. 1 is a schematic view of a drilling system, according to one or more aspects.

The present disclosure describes a drilling system with a mud motor and a bearing assembly. The bearing assembly includes one or more radial bearings, thrust bearings, and/or ball bearings or roller bearings that support a driveshaft that extends between the mud motor and a drill bit for a motor only application or in case of a MARSS application, between the mud motor and an entire bottom hole assembly ("BHA") comprised of, for example, a rotary steerable system ("RSS"), logging while drilling (LWD) and measurement-while-drilling (MWD) tools, dummy collars, and a drill bit. The bearing assembly also includes a fluid flow path through the bearings and into an annulus surrounding the bearing assembly that allows drilling fluid to pass through the bearings, lubricating and cooling the bearings. The bearing assembly also includes an annular flow restrictor. The annular flow restrictor uses an annular gap to control the amount of drilling fluid flowing through the bearing section bypass flow path. Such a configuration causes the flow restrictor to operate as a radial bearing, thus undergoing radial bearing load. The flow restrictor also includes a shape configuration to prevent vibration loading and to have controlled radial loading.

Although the bearing assembly may be used with many types of drilling systems having a mud motor, the bearing assembly is particularly applicable to a motor-assisted rotary steerable system ("MARSS"). A MARSS utilizes drilling fluid that has passed through the mud motor and the bearing assembly, to extend pads to push the drill bit in a desired direction. By restricting the flow of drilling fluid through the bearings of the bearing assembly, the flow restrictor assembly maintains the drilling fluid by-passing through the bearing assembly and hence ensures sufficient and predictable amounts of drilling fluid goes through the driveshaft flow path to the BHA to operate one or more hydraulically operated devices. For example, a downhole turbine will need a minimum amount of drilling fluid flow to turn on and efficiently operate. As a further example, a push-the-pit RSS will require a certain amount of differential pressure across the extendable pads to interact with the wellbore wall and create enough steering force to steer the drill bit.

A subterranean formation containing oil or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched. As used herein, the term "wellbore" includes any cased, and any uncased, open-hole portion of the wellbore. Further, the term "uphole" refers a direction that is towards the surface of the well, while the term "downhole" refers a direction that is away from the surface of the well.

FIG. 1 is a schematic view of a drilling system 100, according to one or more aspects. The drilling system 100 of the present disclosure will be specifically described below such that the system is used to direct a drill bit in drilling a wellbore, such as a subsea well or a land well. Further, it will be understood that the present disclosure is not limited to only drilling an oil well. The present disclosure also encompasses natural gas wellbores, other hydrocarbon wellbores, or wellbores in general. Further, the present disclosure may be used for the exploration and formation of geothermal wellbores intended to provide a source of heat energy instead of hydrocarbons.

FIG. 1 shows a drill string 102 disposed in a directional wellbore 104. A drilling platform 110 supports a derrick 112 having a traveling block 114 for raising and lowering the drill string 102 and a kelly 116 supports the drill string 102 as the drill string 102 is lowered through a rotary table 118. Alternatively, a top drive can be used to rotate the drill string 102 in place of the kelly 116 and the rotary table 118.

The drill string 102 includes a bottom hole assembly ("BHA") 103 at its lower end. The BHA 103 includes a push-the-bit rotary steerable system ("RSS") 106 that provides full 3D directional control of a drill bit 108. The drill bit 108 is positioned at the downhole end of the BHA 103 and is driven by rotation of the drill string 102 from the surface and/or by a downhole mud motor 120 that is part of the BHA 103. As the bit 108 rotates, the bit 108 forms the wellbore 104 that passes through various formations 122. A pump 124 circulates drilling fluid through a feed pipe 126 and downhole through the interior of drill string 102, through orifices in drill bit 108, back to the surface via the annulus 128 around drill string 102, and into a retention pit 130. The drilling fluid transports cuttings from the wellbore 104 into the pit 130 and aids in maintaining the integrity of the wellbore 104. The drilling fluid also drives the mud motor 120, as discussed in more detail below.

The BHA 103 may include one or more logging while drilling (LWD) or measurement-while-drilling (MWD) tools 132 that collect measurements relating to various wellbore and formation properties as well as the position of the bit 108 and various other drilling conditions as the bit 108 extends the wellbore 104 through the formations 122. The LWD/MWD tool 132 may include a device for measuring formation resistivity, a gamma ray device for measuring formation gamma ray intensity, devices for measuring the inclination and azimuth of the BHA 103, pressure sensors for measuring drilling fluid pressure, temperature sensors for measuring wellbore temperature, etc.

The BHA 103 may also include a telemetry module 134 that receives data provided by the various sensors of the BHA 103 (e.g., sensors of the LWD/MWD tool 132), and transmits the data to a surface control unit 136. Data may also be provided by the surface control unit 136, received by the telemetry module 134, and transmitted to the tools (e.g., LWD/MWD tool 132, RSS 106, etc.) of the BHA 103. Mud pulse telemetry, wired drill pipe, acoustic telemetry, or other telemetry technologies known in the art may be used to provide communication between the surface control unit 136 and the telemetry module 134. The surface control unit 136 may also communicate directly with the LWD/MWD tool 132 and/or the RSS 106. The surface control unit 136 may be a computer stationed at the well site, a portable electronic device, a remote computer, or distributed between multiple locations and devices. The surface control unit 136 may also be a control unit that controls functions of the equipment of the BHA 103.

Figure 2:
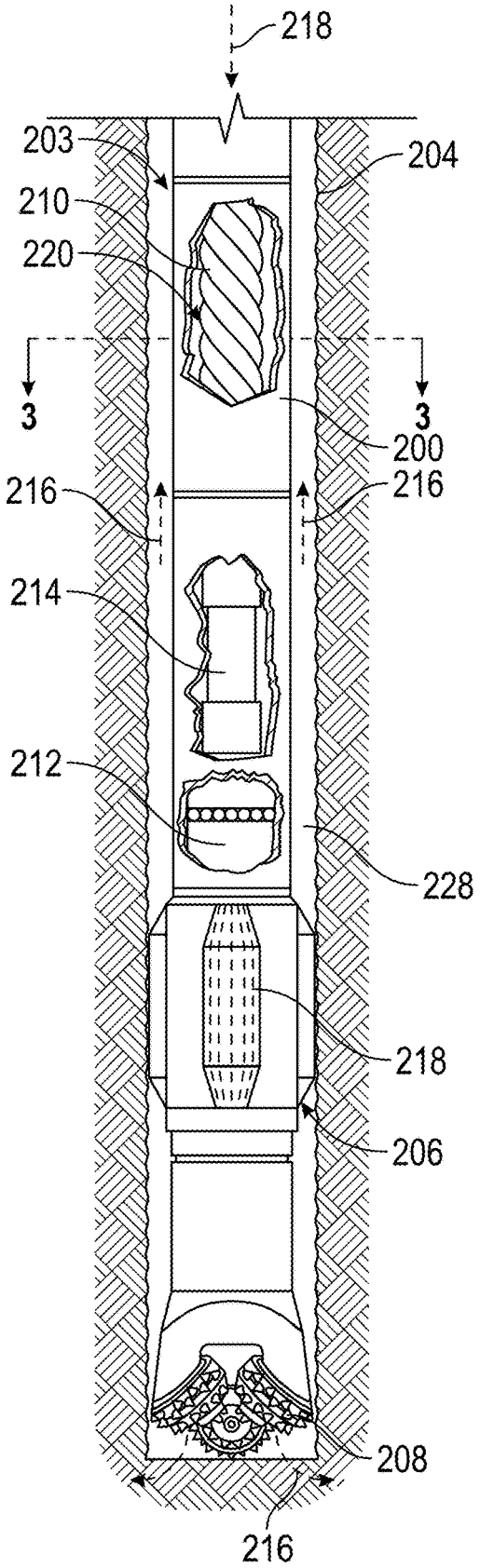
FIG. 2 is a portion of a drill string disposed in a wellbore, according to one or more aspects.
Figure 3:
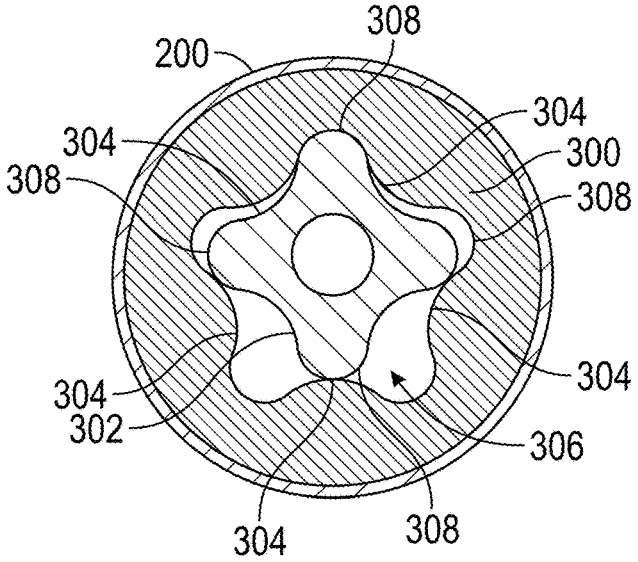
FIG. 3 is a cross-sectional view of the stator and rotor of FIG. 2.

FIGS. 2 and 3 are a broken side view and a cross section view of a BHA 203 attached to a drillstring (not shown) and disposed in a wellbore 204 and that includes a mud motor 220 connected to a drill bit 208. The mud motor 220 includes a tubular housing 200 that encloses a power unit 210. The power unit 210 is connected to a bearing assembly 212 via a transmission unit 214. The bearing assembly 212 supports a driveshaft (not shown) extending between the mud motor 220 and the drill bit 208 wherein operation of the mud motor 220 rotates the driveshaft to rotate the drill bit 208. Referring to FIG. 3, the power unit 210 includes a stator 300 and a rotor 302. The stator 300 includes multiple (e.g., five) lobes 304 extending along the stator 300 in a helical configuration and defining a cavity 306. The rotor 302 also includes lobes 308 extending along the rotor 302 in a helical configuration. The stator 300 and rotor 302 can also have more or fewer lobes where the difference between the rotor lobes 308 and stator lobes 304 is one extra stator lobe 304 for the number of rotor lobes 308.

The rotor 302 is operatively positioned in the cavity 306 such that the rotor lobes cooperate with the stator lobes 304 in that applying fluid pressure to the cavity 306 by flowing fluid within the cavity 306 causes the rotor 302 to rotate within the stator 300. For example, referring to FIGS. 2 and 3, pressurized drilling fluid (e.g., drilling mud) 216 can be introduced at an upper end of the power unit 210 and forced down through the cavity 306. The pressurized drilling fluid entering cavity 306, in cooperation with the lobes 304 of the stator 300 and the geometry of the stator 300 and the rotor 302 causes the rotor 302 to turn to allow the drilling fluid 216 to pass through the motor 220, thus rotating the rotor 302 relative to the stator 300. The drilling fluid 216 subsequently exits through ports (e.g., jets) in the drill bit 208 and travels upward through an annulus 228 between the drill string 202 and the wellbore 204 and is received at the surface where it is captured and pumped down the drill string 202 again.

As shown in FIG. 2, an RSS 206 is positioned on the drill string 202 downhole of the mud motor 220 and the bearing assembly 212. Drilling fluid 216 passes through the mud motor 220 into the driveshaft. A portion of the drilling fluid is diverted from the driveshaft and through the bearing assembly 212 and cools and lubricates the bearings within the bearing assembly 212 before flowing out into the annulus 228. The drilling fluid that was not diverted continues to flow through the driveshaft and provides the hydraulic pressure to extend the pads (one indicated, 218) of the RSS 206 to direct the drill bit 208. If too much drilling fluid is diverted through the bearing assembly 212, there may not be sufficient pressure to extend the pads 218 and steer the drill bit 208. Thus, the amount of drilling fluid 216 diverted through the bearing assembly 212 must be controlled to maintain the amount of hydraulic pressure available to extend the pads 218 of the RSS 206 above an appropriate amount.

Figure 4A:
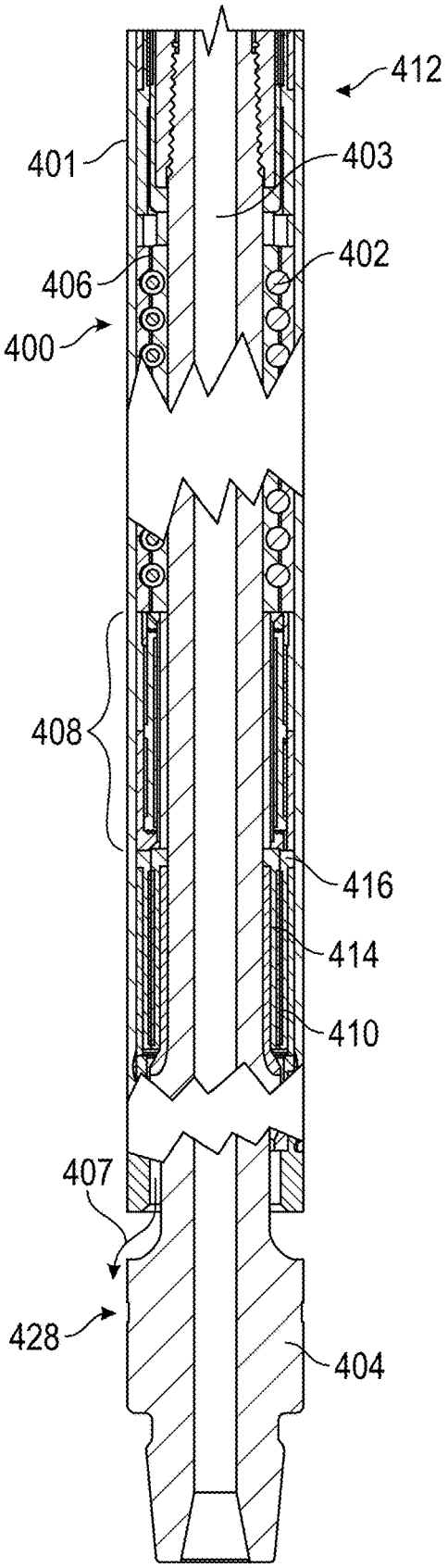
FIGS. 4A-4C are cross section views of a bearing assembly, according to one or more aspects.
Figure 4B:
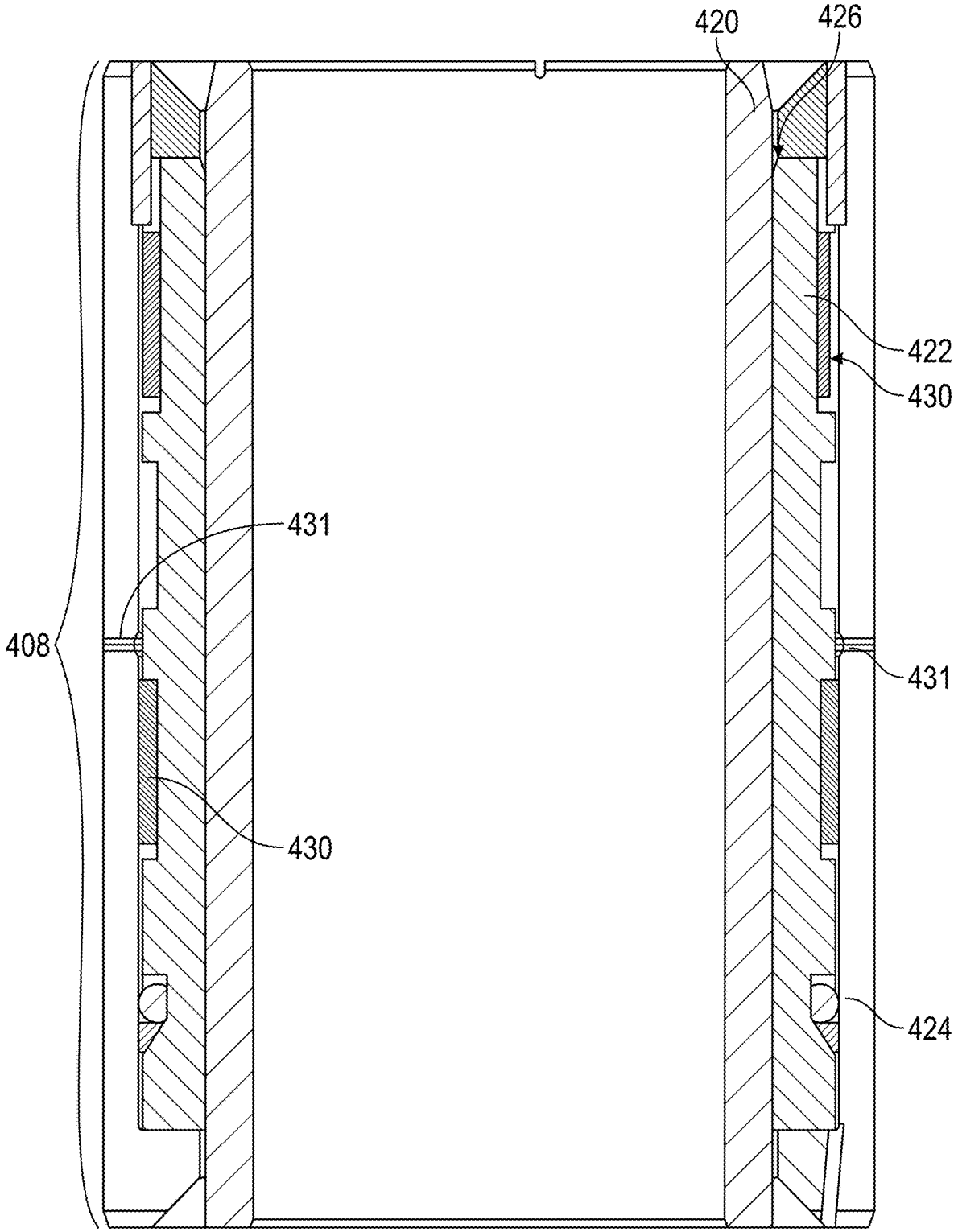
Figure 4C:
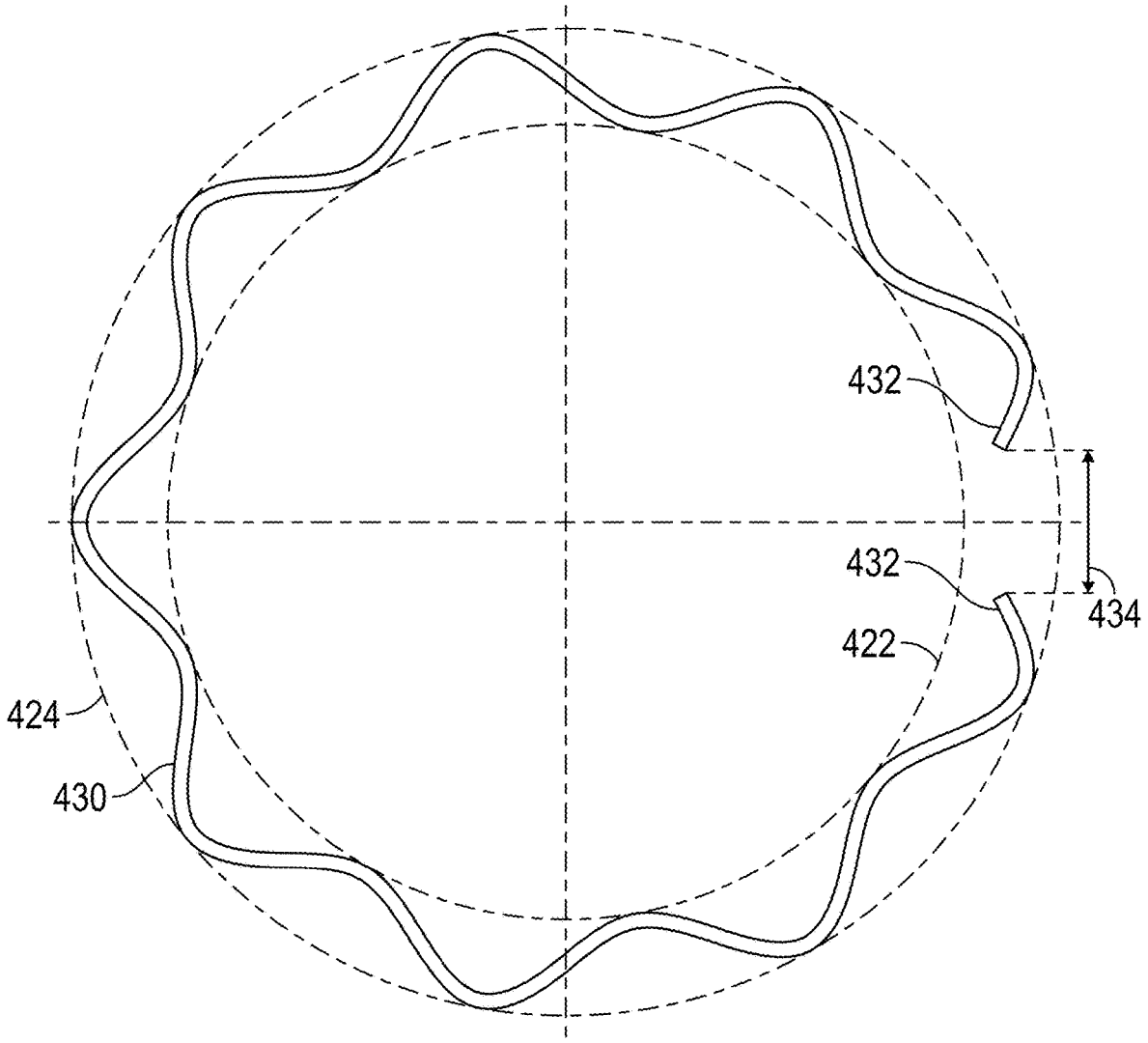

FIGS. 4A-4C illustrate a bearing assembly 400 located within a bearing housing 401 and used in a BHA, according to one or more aspects. The bearing assembly 400 includes one or more radial bearings 412, a ball bearing stack 402 for axial load, roller bearings (not shown), or PDC thrust bearing (not shown) that are positioned circumferentially around a driveshaft 404 that extends between a downhole mud motor (not shown) and a BHA containing the drill bit at the end (not shown) to support the driveshaft 404.

A bypass fluid flow path 406 extends from a bore 403 of the driveshaft 404 and through the bearings 402, 412. As discussed above, a portion of drilling fluid passing through the driveshaft 404 is diverted through the bypass fluid flow path 406 to cool and lubricate the bearings 402, 412. To control too much drilling fluid from diverting into the bypass fluid flow path 406, an annular flow restrictor 408 is disposed within the bypass fluid flow path 406. The annular flow restrictor 408 controls the amount of fluid that passes through the bypass fluid flow path 406 and into an annulus 428 surrounding the bearing assembly 400 through an exit port 407. For example, the annular flow restrictor 408 restricts flow of the diverted drilling fluid out of the bypass fluid flow path 406 and into the annulus 428. By controlling the amount of drilling fluid passing into the annulus 428 via the bypass fluid flow path 406, a backpressure is maintained on the drilling fluid entering the bypass fluid flow path 406 and sufficient hydraulic pressure is maintained in the drilling fluid flowing through the driveshaft 404 to extend the pads of the RSS (not shown) or to operate any hydraulic mechanism.

In at least one aspect, the radial bearing 412 may also act to restrict the flow of fluid through the bypass fluid flow path 406. Specifically, an internal radial gap 410 formed between an inner cylinder 414 and an outer cylinder 416 may be sized to restrict the flow of fluid through the radial gap 410 and, thus, the bypass fluid flow path 406.

FIG. 4B is a cross-sectional view of the annular flow restrictor 408. The annular flow restrictor 408 includes an inner sleeve 420 attached to the driveshaft 404 (not shown in FIG. 4B), an outer sleeve 422, and a restrictor housing 424. During drilling operations, the inner sleeve 420 rotates with the driveshaft 404 while the outer sleeve 422 remains stationary relative to the restrictor housing 424. To help prevent wear due to the relative rotation between the sleeves, the inner sleeve 420 and the outer sleeve 422 may include carbide tiles (not shown) or other wear resistant material on their inwardly facing surfaces.

The annular flow restrictor 408 has a restrictor clearance designated at arrow 426 between the inner sleeve 420 and the outer sleeve 422 that is at least initially smaller than the gap 410 of the radial bearing 412. However, if the restrictor clearance 426 is larger, the bearing assembly 400 may also include a choke (not shown) in the bypass fluid flow path 406 to establish a desired pressure drop across the bypass fluid flow path 406. The restrictor clearance 426 and the length of the annular flow restrictor 408 may be adjusted to adjust the restriction required to successfully control the pressure of the drilling fluid in the driveshaft downstream of the bypass fluid flow path 406 to maintain sufficient flow of fluid in the central bore 403 of the driveshaft 404 for operating the pads of the RSS or for operating any other hydraulic mechanism.

Further, the bearing assembly 400 may include multiple radial bearings 412 placed either upstream or downstream of the annular flow restrictor 408. The radial bearings 412 also may have the same or different internal radial gaps 410. For example, in one aspect, there may be a radial bearing 412 upstream of the annular flow restrictor 408 and another radial bearing downstream of the annular flow restrictor 408. The radial bearings 412 may each have the same internal radial gap 410 that is larger than the restrictor clearance 426 of the annular flow restrictor 408. In another aspect, the upstream radial bearing 412 may have an internal radial gap 410 that is different than the radial gap of the downstream radial bearing 412, both of which are different than the restrictor clearance 426. In such a case, the radial gap 410 of the upstream radial bearing 412 may be the largest, with the restrictor clearance 426 being smaller and the radial gap of the downstream radial bearing 412 being the smallest of the three. Such a staggered configuration may reduce erosion risk and produce a more continuous pressure distribution along the bypass fluid flow path 406.

If the restrictor clearance 426 of the annular flow restrictor 408 is less than the gap 410 of the radial bearings 412, movement of the driveshaft 404 will cause the inner sleeve 420 to contact the outer sleeve 422 before the parts of the radial bearings 412 come into contact. Upon such contact, the annular flow restrictor 408 would act as a radial bearing itself. To address this situation, one or more springs 430 are placed between the outer sleeve 422 and the restrictor housing 424. The springs 430 may be circumferential around the outer sleeve 422 or, as shown in FIG. 4C, the springs 430 need not extend around the circumference of the outer sleeve 422.

The springs 430 allow the annular flow restrictor 408 to move eccentrically or "float" inside the restrictor housing 424 while being spring-loaded. So, as the inner sleeve 420 moves eccentrically into contact with the outer sleeve 422 the inner sleeve 420 contacts the outer sleeve 422. Continued movement of the inner sleeve 420 then compresses the springs 430, relieving some of the radial load on the annular flow restrictor 408 and mitigating harsh conditions that may cause premature degradation of the flow restrictor 408. The displacement of the annular flow restrictor 408 and the circumferential spring 430 will be limited by the gap 410 in the radial bearings 412. With enough movement, the gap 410 of the radial bearings 412 closes, preventing further displacement of the annular flow restrictor 408. Since the annular flow restrictor 408 is "floating", the annular flow restrictor 408 does not act as a primary radial bearing absorbing most of the radial load in the bearing assembly 400. The outer sleeve 422 is thus dynamically radially supported relative to the restrictor housing 424 and moveable eccentrically such that a radial load absorbed by the annular flow restrictor 408 from eccentric movement of the driveshaft is below a selected threshold. Further, the springs 430 allow the annular flow restrictor 408 to operate within a pre-determined spring load envelope based on the spring dynamics of the springs 430. Further, at least one of the springs 430 may comprise different spring dynamics than another one of the springs 430. Thus, the annular flow restrictor 408 will not take radial load beyond a designed limit whereas the radial bearing 412 may undergo excessive bearing load during the bending of the drill string or driveshaft, for example. The springs 430 also restrict the outer sleeve 422 from rotating relative to the restrictor housing 424, even when there is engagement with the inner sleeve 420 that is rotating with the driveshaft. Further, to assist in balancing changes in pressure between the outer sleeve 422 and the restrictor housing 424, the restrictor housing 424 includes pressure balance ports 431 between the restrictor housing 424 and the bearing housing 401. The pressure balance ports 431 allow fluid to move in and out of the restrictor housing 424 as the outer sleeve 422 adjusts radially with respect to the restrictor housing 424.

During operations, the gap 410 of the radial bearings 412 may increase due to wear of the radial bearings 412. Also, the radial bearings 412 need to survive long drilling hours/multiple bit runs so such wear is understandably anticipated. As a result, the annular flow restrictor 408 springs 430 are designed to have a controlled load range to account for the radial displacement of a worn-out radial bearing 412 placing more load on the annular flow restrictor 408 over time. The load range includes loads anticipated upon installation when the gap 410 of the radial bearings 412 is at a minimum, thus placing the least amount of load on the annular flow restrictor 408. The load range also includes loads encountered up to max displacement at the end of service life of the radial bearings 412 when the gap 410 is at a maximum. The springs 430 are also designed to create a known radial load that is sufficiently low to mitigate heat checking/bearing run away even at maximum radial displacement. The springs 430 are also large enough to handle vibration experienced during drilling operations.

Turning now to FIG. 4C, FIG. 4C is a cross section of an example spring 430 of the annular flow restrictor 408 in the form of a wave spring. In addition to being configured in a wave or corrugated cross-section pattern, the spring 430 includes two ends 432 that are separated by a space 434. In this manner, as the spring 430 experiences more load as the radial bearings 412 wear, the spring 430 can compress more, allowing the corrugations to spread further and move the ends 432 closer together. The space 434 between the ends 432 allows the spring 430 to function under a controlled load range over the service life of the annular flow restrictor 408 as well as the radial bearing 412.

Figure 5:
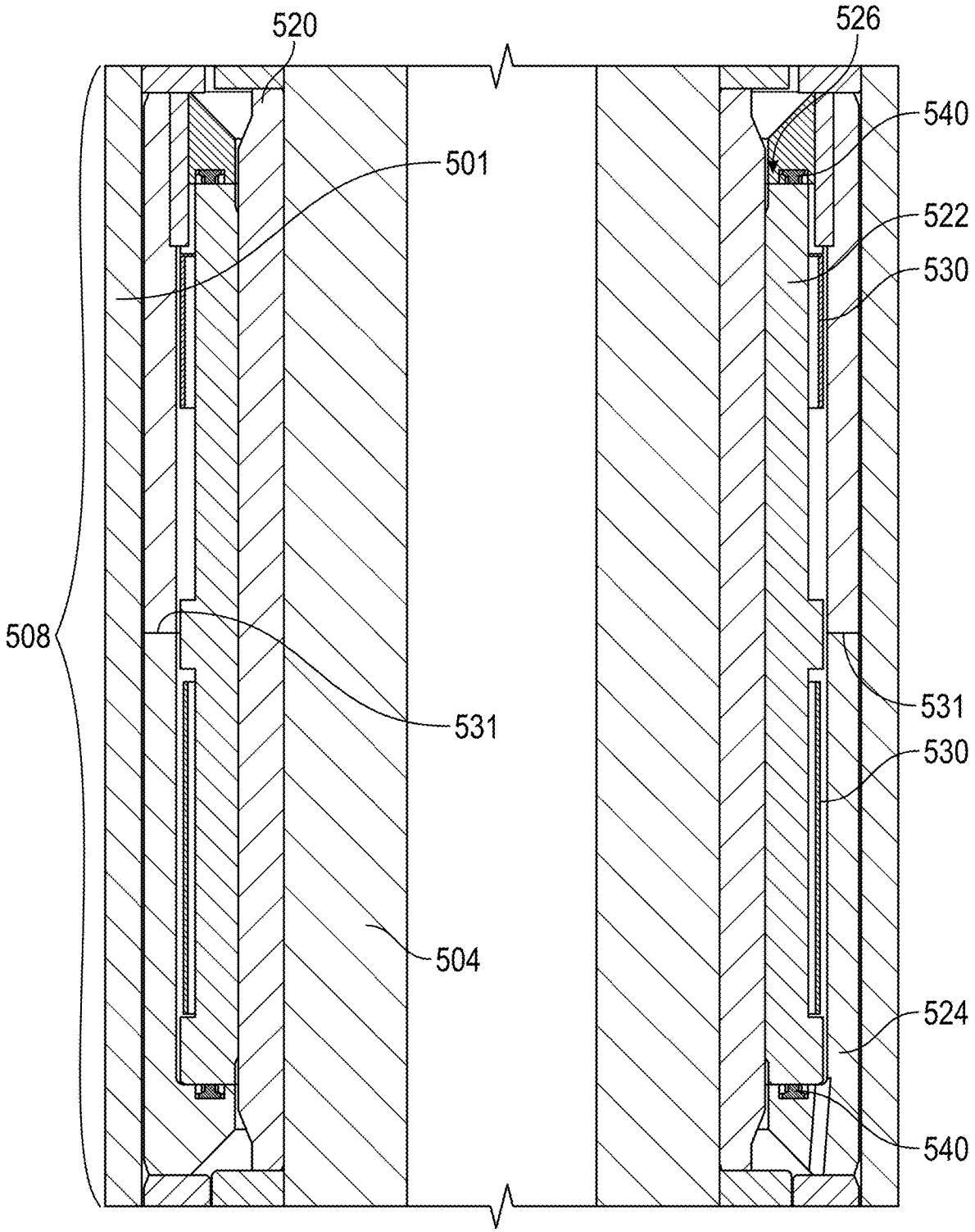
FIG. 5 is an alternative bearing assembly, according to one or more aspects.

Turning now to FIG. 5, FIG. 5 is a close-up view of an alternative annular flow restrictor 508, in accordance with one or more aspects. Like FIG. 4B, the annular flow restrictor 508 includes an inner sleeve 520 connected with a driveshaft 504 (not shown in FIG. 4B), an outer sleeve 522, and a restrictor housing 524 within a bearing housing 501. The annular flow restrictor 508 has a restrictor clearance designated at arrow 526 between the inner sleeve 520 and the outer sleeve 522. During drilling operations, the inner sleeve 520 rotates with the driveshaft 504 while the outer sleeve 522 remains stationary relative to the restrictor housing 524. The annular flow restrictor 508 also includes pressure balance ports 531 between the restrictor housing 524 and the bearing housing 501. The pressure balance ports 531 allow fluid to move in and out of the restrictor housing 524 as the outer sleeve 522 adjusts radially with respect to the restrictor housing 524.

As shown in FIG. 5, the annular flow restrictor 508 may include different numbers and difference sizes of the springs 530. The springs 530 may include a combination of different numbers, widths, thicknesses, materials, and geometric shapes to meet minimum and maximum load criteria that make up a selected spring load envelope for the floating annular flow restrictor 508 during drilling operations. Further, alternatively to the wave spring configuration shown in FIG. 5, the springs 530 may include bow springs, one or more o-rings, rubber molded finned centralizers, or the like if the springs 530 performed the function of allowing the inner sleeve 520 and the outer sleeve 522 to float as described above. As with the aspect of the floating annular flow restrictor 408 shown in FIG. 4B, the floating annular flow restrictor 508 shown in FIG. 5 allow the annular flow restrictor 508 to move eccentrically or "float" inside the restrictor housing 524 while being spring-loaded. Since the annular flow restrictor 508 is "floating", the annular flow restrictor 508 does not act as a primary radial bearing absorbing most of the radial load in the bearing assembly 500.

In addition, the floating annular flow restrictor 508 may include t-seals 540 to prevent flow of drilling fluid through the floating annular flow restrictor 508 to leak through to the location of the springs 530 in the space between the outer sleeve 522 and the restrictor housing 524. Although two t-seals 440 are shown, the floating annular flow restrictor 408 may also only include one t-seal 440. Further, other suitable types of seals than t-seals may be used as appropriate.

Examples of the above aspects include:

Example 1 is a bottom hole assembly ("BHA") for drilling a wellbore using drilling fluid. The BHA comprises a mud motor comprising a driveshaft comprising a bore through which the drilling fluid is flowable, the mud motor being operable to rotate the driveshaft. The BHA also comprises a drill bit coupled to the driveshaft and rotatable by operation of the mud motor. The BHA also comprises a bearing assembly configured to rotatably support the driveshaft. The bearing assembly comprises a radial bearing comprising an internal radial gap; an annular flow restrictor comprising an inner sleeve rotatable with the driveshaft relative to a restrictor housing and an outer sleeve rotationally stationary with respect to the restrictor housing, the inner sleeve and the outer sleeve separated by a restrictor clearance; and a bypass fluid flow path open to the bore and extending through the radial gap and the restrictor clearance such that at least some drilling fluid is diverted from the bore into the bypass fluid flow path. The restrictor clearance is sized to restrict flow of the drilling fluid diverted through the bypass fluid flow path to control a pressure of the drilling fluid in the driveshaft downstream of the bypass fluid flow path, and the outer sleeve is dynamically radially supported relative to the restrictor housing and moveable eccentrically such that a radial load absorbed by the annular flow restrictor from eccentric movement of the driveshaft is below a selected threshold.

In Example 2, the aspects of any preceding paragraph or combination thereof further include wherein in addition to the size of the restrictor clearance, a length of the annular flow restrictor controls at least a portion of the pressure of the drilling fluid in the driveshaft downstream of the bypass fluid flow path.

In Example 3, the aspects of any preceding paragraph or combination thereof further include wherein the outer sleeve is dynamically radially supported by one or more springs between the outer sleeve and the restrictor housing.

In Example 4, the aspects of any preceding paragraph or combination thereof further include wherein the annular flow restrictor is configured to operate within a pre-determined spring load envelope based on spring dynamics of the one or more springs.

In Example 5, the aspects of any preceding paragraph or combination thereof further include more than one spring, with at least one of the springs comprising different spring dynamics than another one of the springs.

In Example 6, the aspects of any preceding paragraph or combination thereof further include wherein the bearing assembly further comprises at least one of a roller bearing, or a thrust bearing that are positioned circumferentially around the driveshaft to rotatably support the driveshaft.

In Example 7, the aspects of any preceding paragraph or combination thereof further include wherein the BHA further comprises a rotary steerable system ("RSS") comprising pads extendable using the pressure of the drilling fluid in the driveshaft downstream of the bypass fluid flow path.

In Example 8, the aspects of any preceding paragraph or combination thereof further include wherein the restrictor clearance is less than the internal radial gap.

In Example 9, the aspects of any preceding paragraph or combination thereof further include wherein the radial bearing absorbs most of the radial load from the eccentric movement of the driveshaft relative to the bearing assembly.

Example 10 is a method of drilling a wellbore that comprises flowing drilling fluid within the wellbore to operate a mud motor to rotate a driveshaft to rotate a drill bit to drill the wellbore. The method also comprises rotatably supporting the driveshaft using a bearing assembly comprising a radial bearing comprising an internal radial gap. The method also comprises diverting at least portion of the drilling fluid from a bore of the driveshaft into a bypass fluid flow path through the bearing assembly. The method also comprises controlling a pressure of the drilling fluid in the driveshaft downstream of the bypass fluid flow path by restricting flow of the drilling fluid into the bypass fluid flow path using an annular flow restrictor. Restricting flow into the bypass fluid flow path further comprises the annular flow restrictor creating a restrictor clearance between an inner sleeve rotatable with the driveshaft relative to a restrictor housing and an outer sleeve rotationally stationary with respect to the restrictor housing. Dynamically radially supporting the outer sleeve and allowing the outer sleeve to move eccentrically relative to the restrictor housing such that a radial load absorbed by the annular flow restrictor from eccentric movement of the driveshaft is below a selected threshold.

In Example 11, the aspects of any preceding paragraph or combination thereof further include wherein controlling the pressure of the drilling fluid in the driveshaft downstream of the bypass fluid flow path further comprises restricting flow of the drilling fluid into the bypass fluid flow path based on a length of the annular flow restrictor.

In Example 12, the aspects of any preceding paragraph or combination thereof further include wherein dynamically radially supporting the outer sleeve further comprises supporting using one or more springs between the outer sleeve and the restrictor housing.

In Example 13, the aspects of any preceding paragraph or combination thereof further include operating the annular flow restrictor within a pre-determined spring load envelope based on spring dynamics of the one or more springs.

In Example 14, the aspects of any preceding paragraph or combination thereof further include dynamically radially supporting using more than one spring, with at least one of the springs comprising different spring dynamics than another one of the springs.

In Example 15, the aspects of any preceding paragraph or combination thereof further include wherein rotatably supporting the driveshaft further comprises using at least one of a roller bearing or a thrust bearing positioned circumferentially around the driveshaft.

In Example 16, the aspects of any preceding paragraph or combination thereof further include absorbing most of the radial load of the bearing assembly from eccentric movement of the driveshaft relative to the bearing assembly with the radial bearing.

In Example 17, the aspects of any preceding paragraph or combination thereof further include flowing at least some of the diverted drilling fluid past the annular flow restrictor and into an annulus in the wellbore outside of the bearing assembly.

In Example 18, the aspects of any preceding paragraph or combination thereof further include orienting the drill bit using a rotary steerable system ("RSS") operated using the pressure the drilling fluid flowing through the bore of the driveshaft downstream of the bypass fluid flow path to extend pads of the RSS.

In Example 19, the aspects of any preceding paragraph or combination thereof further include wherein the restrictor clearance is less than the internal radial gap.

Example 20 is a bearing assembly for rotatably supporting a driveshaft rotated by a mud motor rotated via drilling fluid flowing through the mud motor and the driveshaft. The bearing assembly comprises a radial bearing comprising an internal radial gap. The bearing assembly also comprises an annular flow restrictor comprising an inner sleeve rotatable with the driveshaft relative to a restrictor housing and an outer sleeve rotationally stationary with respect to the restrictor housing, the inner sleeve and the outer sleeve separated by a restrictor clearance. The bearing assembly also comprises a bypass fluid flow path open to a bore of the driveshaft and extending through the radial gap and the restrictor clearance such that at least some drilling fluid is diverted from the bore into the bypass fluid flow path. The restrictor clearance is sized to restrict the drilling fluid diverted through the bypass fluid flow path to control a pressure of the drilling fluid in the driveshaft downstream of the bypass fluid flow path. The outer sleeve is dynamically radially supported relative to the restrictor housing and moveable eccentrically such that a radial load absorbed by the annular flow restrictor from eccentric movement of the driveshaft is below a selected threshold.

Certain terms are used throughout the description and claims to refer to particular features or components. As one skilled in the art will appreciate, different persons may refer to the same feature or component by different names. This document does not intend to distinguish between components or features that differ in name but not function.

While descriptions herein may relate to "comprising" various components or steps, the descriptions can also "consist essentially of" or "consist of" the various components and steps.

Unless otherwise indicated, all numbers expressing quantities are to be understood as being modified in all instances by the term "about" or "approximately". Accordingly, unless indicated to the contrary, the numerical parameters are approximations that may vary depending upon the desired properties of the present disclosure. As used herein, "about", "approximately", "substantially", and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 5% of the particular term.

The aspects disclosed should not be interpreted, or otherwise used, as limiting the scope of the disclosure, including the claims. It is to be fully recognized that the different teachings of the aspects discussed may be employed separately or in any suitable combination to produce desired results. In addition, one skilled in the art will understand that the description has broad application, and the discussion of any aspect is meant only to be exemplary of that aspect, and not intended to suggest that the scope of the disclosure, including the claims, is limited to that aspect.

What is claimed is:

1. A bottom hole assembly ("BHA") for drilling a wellbore using drilling fluid, the BHA comprising:

a mud motor comprising a driveshaft comprising a bore through which the drilling fluid is flowable, the mud motor being operable to rotate the driveshaft;

a drill bit coupled to the driveshaft and rotatable by operation of the mud motor; and a bearing assembly configured to rotatably support the driveshaft, the bearing assembly comprising:

a radial bearing comprising an internal radial gap;

an annular flow restrictor comprising an inner sleeve rotatable with the driveshaft relative to a restrictor housing and an outer sleeve rotationally stationary with respect to the restrictor housing, the inner sleeve and the outer sleeve separated by a restrictor clearance; and a bypass fluid flow path open to the bore and extending through the radial gap and the restrictor clearance such that at least some drilling fluid is diverted from the bore into the bypass fluid flow path, wherein the restrictor clearance is sized to restrict flow of the drilling fluid diverted through the bypass fluid flow path to control a pressure of the drilling fluid in the driveshaft downstream of the bypass fluid flow path, and wherein the outer sleeve is dynamically radially supported relative to the restrictor housing and moveable eccentrically such that a radial load absorbed by the annular flow restrictor from eccentric movement of the driveshaft is below a selected threshold.

2. The BHA of claim 1, wherein in addition to the size of the restrictor clearance, a length of the annular flow restrictor controls at least a portion of the pressure of the drilling fluid in the driveshaft downstream of the bypass fluid flow path.

3. The BHA of claim 1, wherein the outer sleeve is dynamically radially supported by one or more springs between the outer sleeve and the restrictor housing.

4. The BHA of claim 3, wherein the annular flow restrictor is configured to operate within a pre-determined spring load envelope based on spring dynamics of the one or more springs.

5. The BHA of claim 3, further comprising more than one spring, with at least one of the springs comprising different spring dynamics than another one of the springs.

6. The BHA of claim 1, wherein the bearing assembly further comprises at least one of a roller bearing, or a thrust bearing that are positioned circumferentially around the driveshaft to rotatably support the driveshaft.

7. The BHA of claim 1, wherein the BHA further comprises a rotary steerable system ("RSS") comprising pads extendable using the pressure of the drilling fluid in the driveshaft downstream of the bypass fluid flow path.

8. The BHA of claim 1, wherein the restrictor clearance is less than the internal radial gap.

9. The BHA of claim 1, wherein the radial bearing absorbs most of the radial load from the eccentric movement of the driveshaft relative to the bearing assembly.

10. A method of drilling a wellbore, the method comprising:

flowing drilling fluid within the wellbore to operate a mud motor to rotate a driveshaft to rotate a drill bit to drill the wellbore;

rotatably supporting the driveshaft using a bearing assembly comprising a radial bearing comprising an internal radial gap;

diverting at least portion of the drilling fluid from a bore of the driveshaft into a bypass fluid flow path through the bearing assembly;

controlling a pressure of the drilling fluid in the driveshaft downstream of the bypass fluid flow path by restricting flow of the drilling fluid into the bypass fluid flow path using an annular flow restrictor;

wherein restricting flow into the bypass fluid flow path further comprises the annular flow restrictor creating a restrictor clearance between an inner sleeve rotatable with the driveshaft relative to a restrictor housing and an outer sleeve rotationally stationary with respect to the restrictor housing; and dynamically radially supporting the outer sleeve and allowing the outer sleeve to move eccentrically relative to the restrictor housing such that a radial load absorbed by the annular flow restrictor from eccentric movement of the driveshaft is below a selected threshold.

11. The method of claim 10, wherein controlling the pressure of the drilling fluid in the driveshaft downstream of the bypass fluid flow path further comprises restricting flow of the drilling fluid into the bypass fluid flow path based on a length of the annular flow restrictor.

12. The method of claim 10, wherein dynamically radially supporting the outer sleeve further comprises supporting using one or more springs between the outer sleeve and the restrictor housing.

13. The method of claim 12, further comprising operating the annular flow restrictor within a pre-determined spring load envelope based on spring dynamics of the one or more springs.

14. The method of claim 12, further comprising dynamically radially supporting using more than one spring, with at least one of the springs comprising different spring dynamics than another one of the springs.

15. The method of claim 10, wherein rotatably supporting the driveshaft further comprises using at least one of a roller bearing or a thrust bearing positioned circumferentially around the driveshaft.

16. The method of claim 10, further comprising absorbing most of the radial load of the bearing assembly from eccentric movement of the driveshaft relative to the bearing assembly with the radial bearing.

17. The method of claim 10, further comprising flowing at least some of the diverted drilling fluid past the annular flow restrictor and into an annulus in the wellbore outside of the bearing assembly.

18. The method of claim 10, further comprising orienting the drill bit using a rotary steerable system ("RSS") operated using the pressure the drilling fluid flowing through the bore of the driveshaft downstream of the bypass fluid flow path to extend pads of the RSS.

19. The method of claim 10, wherein the restrictor clearance is less than the internal radial gap.

20. A bearing assembly for rotatably supporting a driveshaft rotated by a mud motor rotated via drilling fluid flowing through the mud motor and the driveshaft, the bearing assembly comprising:

a radial bearing comprising an internal radial gap;

an annular flow restrictor comprising an inner sleeve rotatable with the driveshaft relative to a restrictor housing and an outer sleeve rotationally stationary with respect to the restrictor housing, the inner sleeve and the outer sleeve separated by a restrictor clearance; and a bypass fluid flow path open to a bore of the driveshaft and extending through the radial gap and the restrictor clearance such that at least some drilling fluid is diverted from the bore into the bypass fluid flow path, wherein the restrictor clearance is sized to restrict the drilling fluid diverted through the bypass fluid flow path to control a pressure of the drilling fluid in the driveshaft downstream of the bypass fluid flow path, and wherein the outer sleeve is dynamically radially supported relative to the restrictor housing and moveable eccentrically such that a radial load absorbed by the annular flow restrictor from eccentric movement of the driveshaft is below a selected threshold.

* * * * *